US009270033B2

(12) United States Patent
Alvarez Vazquez et al.

(10) Patent No.: US 9,270,033 B2
(45) Date of Patent: Feb. 23, 2016

(54) LUG RETENTION ARRANGEMENT

(71) Applicant: Siemens Industry, Inc., Alpharetta, GA (US)

(72) Inventors: Pedro Alvarez Vazquez, Nuevo Leon (MX); Justin Cyle Bennett, Atlanta, GA (US); Hector Manuel Malacara-Carrillo, Norcross, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 14/483,420

(22) Filed: Sep. 11, 2014

(65) Prior Publication Data

US 2015/0180139 A1 Jun. 25, 2015

Related U.S. Application Data

(60) Provisional application No. 61/918,618, filed on Dec. 19, 2013.

(51) Int. Cl.
*H01R 11/03* (2006.01)
*H01R 4/30* (2006.01)
*H01R 4/36* (2006.01)

(52) U.S. Cl.
CPC . *H01R 4/305* (2013.01); *H01R 4/36* (2013.01)

(58) Field of Classification Search
CPC ..... H01R 4/30; H01R 4/32; H01R 4/36; H01R 4/305; H01R 4/4872; H01R 9/0524
USPC ..... 439/790–793, 801, 810, 814, 813, 439/816–818
See application file for complete search history.

(56) References Cited

U.S. PATENT DOCUMENTS 2,285,928 A * 6/1942 Jensen ..... H01R 4/36 200/284
3,335,399 A * 8/1967 Rys ..... H01H 1/5855 439/739
3,344,394 A * 9/1967 Kingsbury ..... H01H 71/08 200/237
3,891,298 A * 6/1975 Yorgin ..... H01H 71/08 439/620.08
4,603,376 A * 7/1986 Maier ..... H01R 4/36 200/284
5,005,104 A * 4/1991 Grunert ..... H01H 71/08 335/202
5,206,789 A * 4/1993 Barbry ..... H01H 71/08 200/284
5,533,913 A * 7/1996 Boehm ..... H01R 4/36 439/810
6,084,188 A * 7/2000 Mueller ..... H01H 71/08 200/305

(Continued)

FOREIGN PATENT DOCUMENTS

JP EP 1596471 A1 * 11/2005 ..... H01R 4/34

*Primary Examiner* — Neil Abrams
*Assistant Examiner* — Travis Chambers

(57) ABSTRACT

A lug arrangement for electrically connecting a conductor to a terminal of a circuit breaker. The lug arrangement includes a lug having a lug opening and first and second holes. The lug opening includes an opening for receiving the conductor and a slot for receiving the terminal. The lug arrangement includes a lug screw threadably engaged with the first hole for compressing the conductor against the terminal. Further, the lug arrangement includes a lug retainer for insertion into both the second hole and a third hole formed in the terminal. The lug retainer includes at least one protrusion that is moveable from a first position to a deflected position for enabling insertion of the lug retainer into the second hole. The at least one protrusion is also moveable back to the first position wherein the protrusion engages the second hole to attach the lug retainer to the lug.

13 Claims, 5 Drawing Sheets

(56) References Cited

U.S. PATENT DOCUMENTS 6,172,586 B1 * 1/2001 Ferree ..... H01H 71/08 335/202
6,234,850 B1 * 5/2001 Pandit ..... H01R 4/34 439/801
6,280,264 B1 * 8/2001 Whipple ..... H01H 11/0031 335/202
6,437,268 B1 * 8/2002 Etscheidt ..... H01H 71/08 200/305
6,529,112 B1 * 3/2003 Leone ..... H01R 4/36 337/113
6,930,577 B2 * 8/2005 Subramanian ..... H01H 1/2058 200/304
8,834,211 B2 * 9/2014 Sommer ..... H01R 4/646 439/814
8,870,609 B2 * 10/2014 Eberts ..... H01H 71/08 439/814
2009/0047845 A1 * 2/2009 Robinson ..... H01R 4/36 439/814
2013/0252486 A1 * 9/2013 Kosyanchuk ..... H01R 4/363 439/813
2015/0180139 A1 * 6/2015 Alvarez Vazquez ..... H01R 4/36 439/793

* cited by examiner

LUG RETENTION ARRANGEMENT

CROSS REFERENCE TO RELATED APPLICATION

This application claims the benefit under 35 U.S.C. §119 (e) of U.S. Provisional Application No. 61/918,618 entitled LUG TERMINAL ASSEMBLY, filed on Dec. 19, 2013, which is incorporated herein by reference in its entirety and to which this application claims the benefit of priority.

FIELD OF THE INVENTION

The invention relates to a lug assembly for an electrical power distribution device, and more particularly, to a lug retention arrangement that includes a lug retainer having at least one moveable protrusion that engages a hole in the lug to attach the lug retainer to the lug and wherein the lug retainer extends through a hole in a terminal to inhibit movement of the lug relative to the terminal.

BACKGROUND OF THE INVENTION

A circuit breaker is used to protect an electric circuit from damage caused by a persistent overcurrent condition, short circuit, fault or other malfunction. FIG. 1 generally depicts an exemplary three phase circuit breaker 1. The circuit breaker 1 includes a handle 3 that extends from a housing 5 that is molded from an insulating material. The handle 3 is moveable between on, off and tripped positions to enable an operating mechanism located in the housing 5 to engage and disengage a moveable contact and a stationary contact for each of the three phases in a well-known manner, such that a line terminal 7 and load terminal 9 of each phase are electrically connected.

The line 7 and load 9 terminals of the circuit breaker 1 are connected to associated wires of the electric circuit by a connector or lug. One type of lug includes a lug body having a conductor hole for receiving a conductor portion of a wire and a threaded hole that is perpendicular to the conductor hole. The lug further includes a lug screw that is threadably engaged with the threaded hole to form a lug assembly. In order to connect a wire to the circuit breaker, an installer strips an end of wire insulation to expose a conductor. The conductor is then inserted into the conductor hole such that, when the installer tightens the lug screw, the body of the screw enters the conductor hole and contacts the conductor. The lug screw is then tightened to compress the conductor against the terminal and to prevent the conductor from being pulled from the lug assembly during normal use.

Circuit breakers are typically shipped from the factory with one or more lug assemblies that are to be used by an installer at a work site, for example, to connect a circuit breaker to wires of an electric circuit. It is desirable to hold the lugs in a set-up position on the terminals so that they are readily accessible to an installer so as to reduce assembly time. A threaded fastener element may be used to attach a lug to a terminal of a circuit breaker. A disadvantage with this arrangement is that a tool such as a conventional screwdriver, or a pneumatic, electric or hydraulic screwdriver, must be used to tighten the fastener element. In addition, a calibrated torque wrench is needed as part of a quality assurance check to ensure that a desired torque value has been applied to the fastener element. Alternatively, the lug may be molded into the housing of a circuit breaker. A disadvantage with this arrangement is that the lug is not removable from the housing. Therefore, if the lug screw is damaged for example, the entire circuit breaker must be replaced since the lug cannot be removed from the housing.

SUMMARY OF INVENTION

A lug arrangement for electrically connecting a conductor to a terminal of an electrical power distribution device is disclosed. The lug arrangement includes a lug having a lug opening and first and second holes. The lug opening includes a conductor opening for receiving the conductor and a slot for receiving the terminal. The lug arrangement also includes a lug screw threadably engaged with the first hole for compressing the conductor against the terminal. Further, the lug arrangement includes a lug retainer for insertion into both the second hole and a third hole formed in the terminal. The lug retainer includes at least one moveable protrusion wherein the protrusion is moveable from a first position to a deflected position for enabling insertion of the lug retainer into the second hole. The protrusion is also moveable back to the first position wherein the protrusion engages the second hole to attach the lug retainer to the lug. The lug retainer inhibits movement of the lug relative to the terminal. In an alternate embodiment, the lug retainer includes a ring portion that abuts against a surface of the lug. In a further embodiment, the lug retainer is sized to form a press-fit arrangement to attach the lug retainer.

The respective features of the present invention may be applied jointly or severally in any combination or sub-combination by those skilled in the art.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
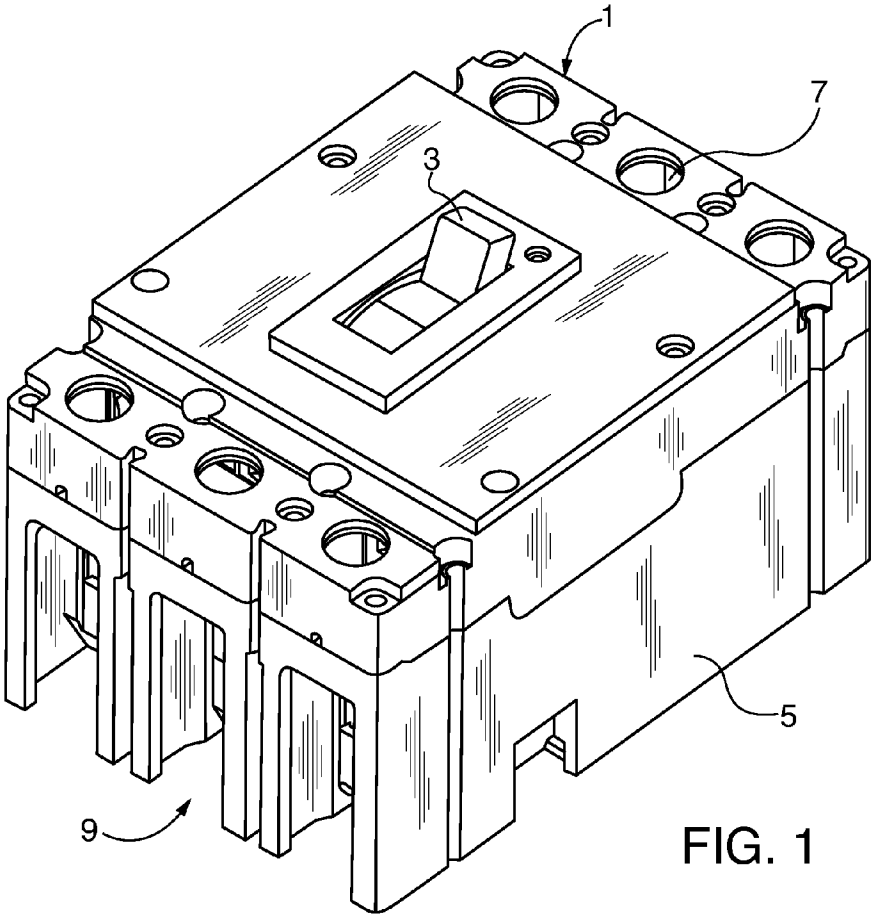
FIG. 1 generally depicts a three phase circuit breaker.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 2:
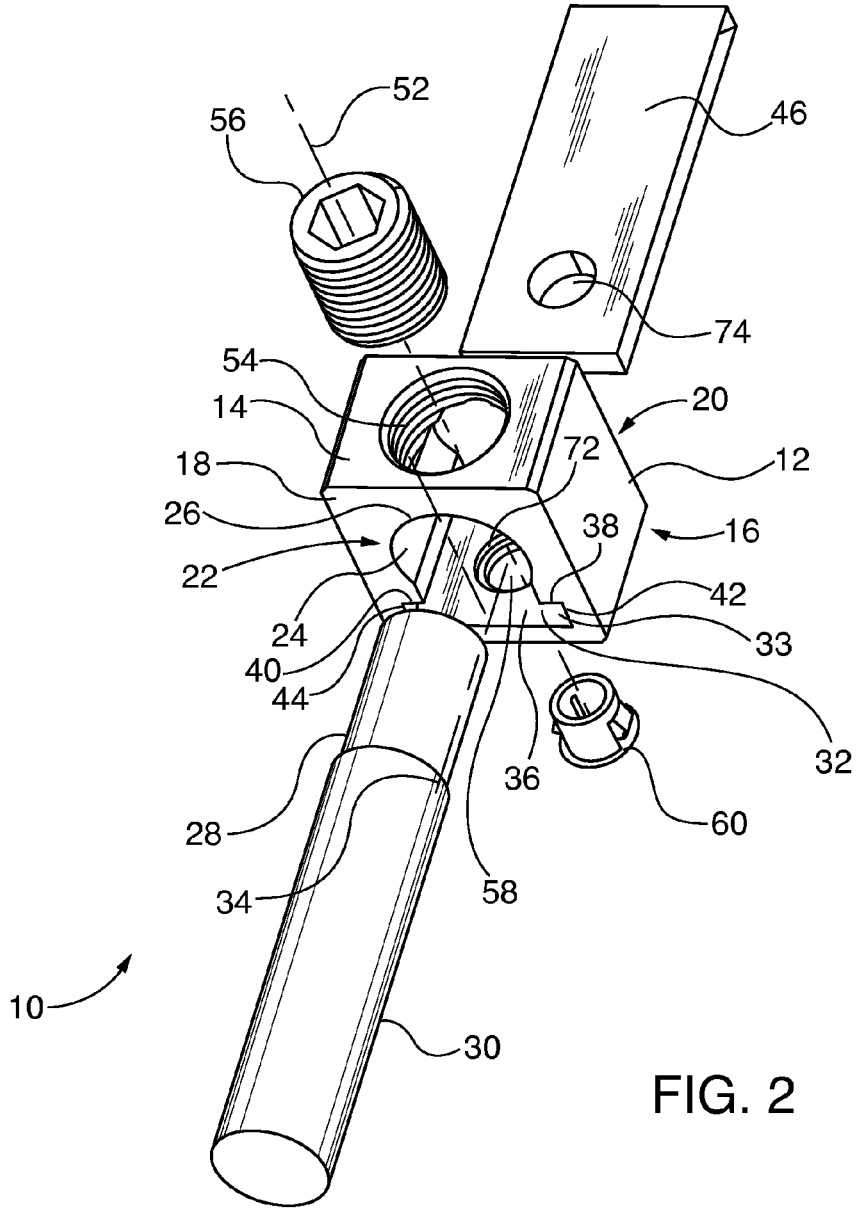
FIG. 2 depicts a lug assembly in accordance with the invention in an exploded view.

Referring to FIG. 2, a lug arrangement or assembly 10 in accordance with the invention is shown in an exploded view. The assembly 10 includes a substantially cube shaped connector or lug element 12 having top 14 and bottom 16 surfaces and front 18 and rear 20 surfaces. A lug opening 22 extends through the lug 12 between the front 18 and rear 20 surfaces. The lug opening 22 includes a conductor opening section 24 having a curved surface 26 to form a partially rounded shape for receiving a substantially round conductor portion 28 of a wire 30. In an embodiment, the lug 12 is fabricated from an aluminum alloy.

The lug opening 22 also includes a terminal opening section 32 oriented along a first axis 34 of the terminal 46 and lug 12. The terminal opening 32 includes a lower surface 36, first 38 and second 40 upper surfaces and first 42 and second 44 lateral surfaces to form a slot 33 having a partial rectangular shape for receiving either a line or load terminal 46 having a substantially rectangular shape. The slot 33 enables movement of the lug 12 relative to the terminal 46 along the first axis 34 and inhibits movement of the lug 12 along a second axis 52 transverse to the first axis 34. In an embodiment, the terminal 46 may be associated with a residential or industrial circuit breaker. Alternatively, the terminal 46 may be associated with other electrical power distribution devices such as contactors, relays, panelboards, switchboards and others.

Alternatively, the conductor 28 and terminal 46 openings may have other shapes such as oval, square and others for accommodating conductors and/or terminals having corresponding shapes. In FIG. 2, the conductor 28 and terminal 46 are depicted as being inserted into the lug opening 22 via the front 18 and rear 20 side surfaces, respectively, although it is understood that the conductor 28 and terminal 46 may be inserted into the lug opening 22 via the rear 20 and front 18 surfaces, respectively.

Figure 3:
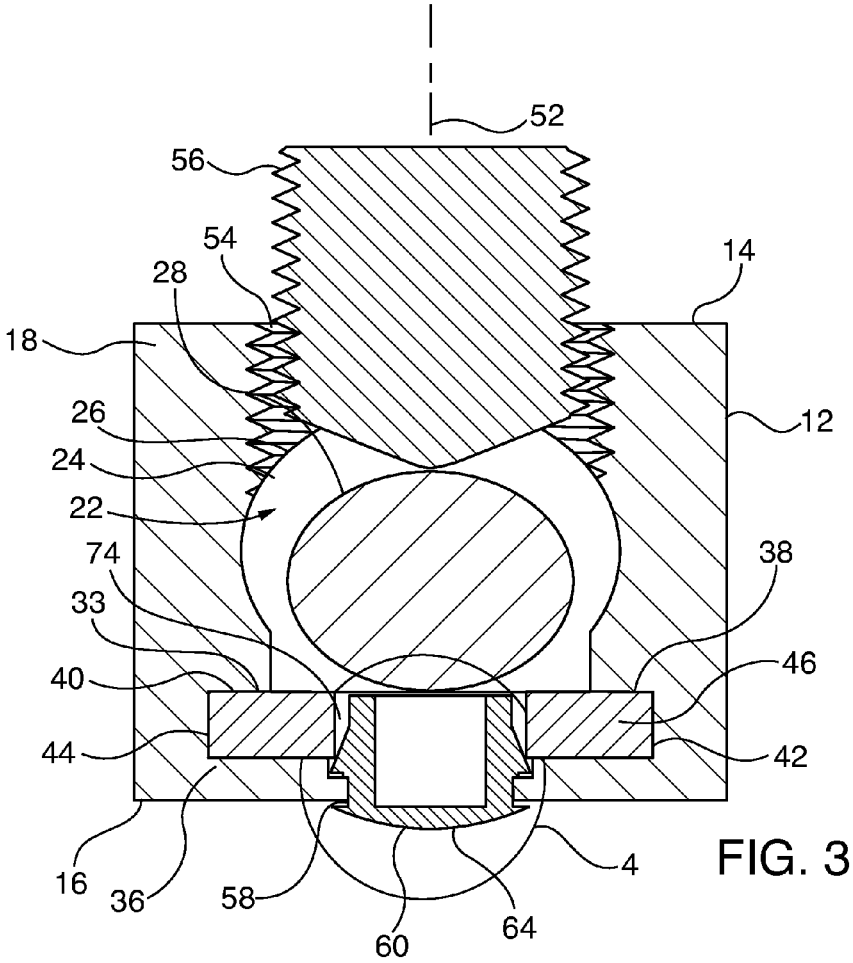
FIG. 3 is a cross sectional side view of the lug assembly.
Figure 4:
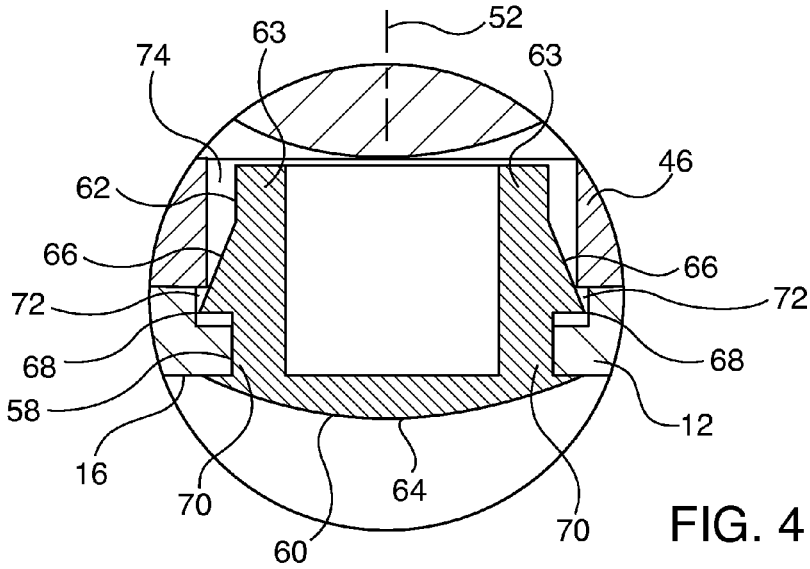
FIG. 4 is an enlarged view of balloon section 4 of FIG. 3.

The top surface 14 includes a threaded hole 54 for receiving a lug screw 56. The bottom surface 16 includes a lug aperture 58 for receiving a fastener such as a lug retainer element 60. Referring to FIG. 3, a cross sectional side view of the assembly 12 is shown. FIG. 4 is an enlarged view of balloon section 4 of FIG. 3. Referring to FIGS. 2-4, the terminal 46 is inserted into the slot 33 along the first axis 34 such that the lug aperture 58 is aligned, with a terminal aperture 74 formed in the terminal 46. The lug retainer 60 is then inserted through the lug 58 and terminal 74 apertures, thus inhibiting movement of the lug 12 relative to the terminal 46 along the first axis 34. In accordance with the invention, the lug retainer 60 is inserted by hand, for example, by using an index finger of a person assembling the lug retainer 60.

The lug retainer 60 includes a body portion 62 which extends from an end cap portion 64 that is sized larger than the lug aperture 58. The body 62 includes walls 63 having outwardly extending slope portions 66 each forming a protrusion 68. In an embodiment, the lug retainer 60 includes two protrusions 68, although it is understood that one protrusion. 68 or more than two protrusions 68 and associated slope portions 66 may be utilized. In order to insert the lug retainer 60, the body 62 is first aligned with the lug aperture 58. In a first position, the walls 63 of the lug retainer 60 are oriented substantially parallel to each other such that the protrusions 68 extend beyond an edge 70 of the lug aperture 58. The walls 63, slope portions 66 and protrusions 68 are fabricated from a resilient material such as a thermoplastic. Upon insertion of the body 62 into the lug aperture 58, the slope portions 66 contact the edge 70 of the lug aperture 58. This causes the walls 63 and slope portions 66 to deflect inwardly toward the second axis 52 such that the protrusions 68 are moved within the lug aperture 58 and into a second position, thus enabling the body 62 to be inserted into the lug aperture 58. The body 62 is inserted until the protrusions 68 clear the edge 70 and enter into a recessed portion 72 of the lug aperture 58. When this occurs, the protrusions 68 snap back and return to the first position such that the protrusions 68 are located within the recessed portion 72 and the end cap 64 abuts against the bottom surface 16, thus capturing the lug retainer 60 within the lug 12. Further, the body 62 extends through the terminal aperture 74, thus inhibiting movement of the lug 12 relative to the terminal 46 along the first axis 34. As a result, movement of the lug. 12 along both the first 34 and second 52 axes is inhibited. In another embodiment, the recessed portion 72 may be formed in the terminal aperture 74. In a further embodiment, a recessed portion 72 may be formed in both the lug 58 and terminal 74 apertures. Alternatively, the body 62 and terminal aperture 74 are configured to form a shrink fit arrangement.

Thus, the current invention enables attachment of the lug 12 to the terminal 46 by hand and without the use of a tool such as a conventional screwdriver, or a pneumatic, electric or hydraulic screwdriver. In addition, a calibrated torque wrench and a quality assurance check to ensure that a desired torque value has been applied to a retaining element are not needed. This simplifies the process for attaching the retaining element and reduces the likelihood of errors. Further, the amount of time needed to attach the retaining element is reduced, thus saving costs.

The current invention ensures that lug 12 is attached to the terminal 46 during assembly, packaging and shipping of an electrical power distribution device such as a circuit breaker, for example. In particular, the lug retainer 60 holds an associated lug 12 in a set-up position on a terminal 46 so that the lug 12 is readily accessible to an installer at a work site, for example, therefore reducing assembly time.

At a work site, an installer may then insert the conductor 28 into the conductor opening 24 and tighten the lug screw 56. This compresses the conductor 28 between the lug screw 56 and the terminal 46 thus forming electrical contact between the conductor 28 and the terminal 46 and securing the conductor 28.

The lug retainer 60 may be kept in place after the conductor 28 is secured. Alternatively, the lug retainer 60 may be removed by using a tool such as a screwdriver to push out the lug retainer 60. Thus, the current invention provides advantages with respect to manufacture and assembly and enables a customer to remove the lug retainer 60 as desired. Thereafter, if reassembly is required, a new lug retainer 60 may be reinserted.

Figure 5:
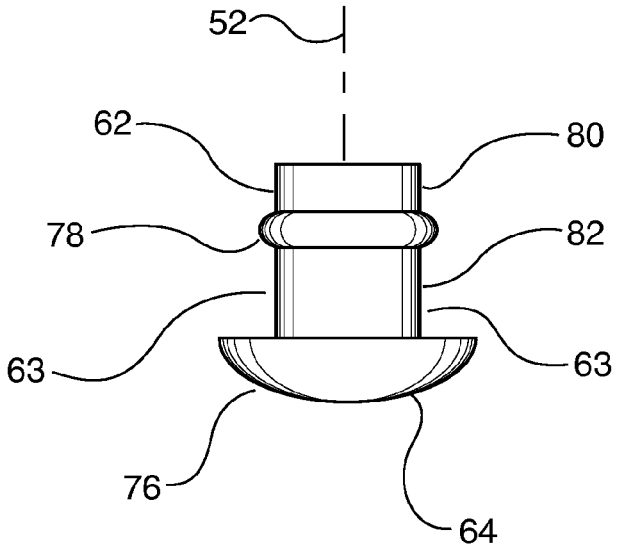
FIG. 5 depicts an alternate embodiment for a lug retainer.
Figure 6:
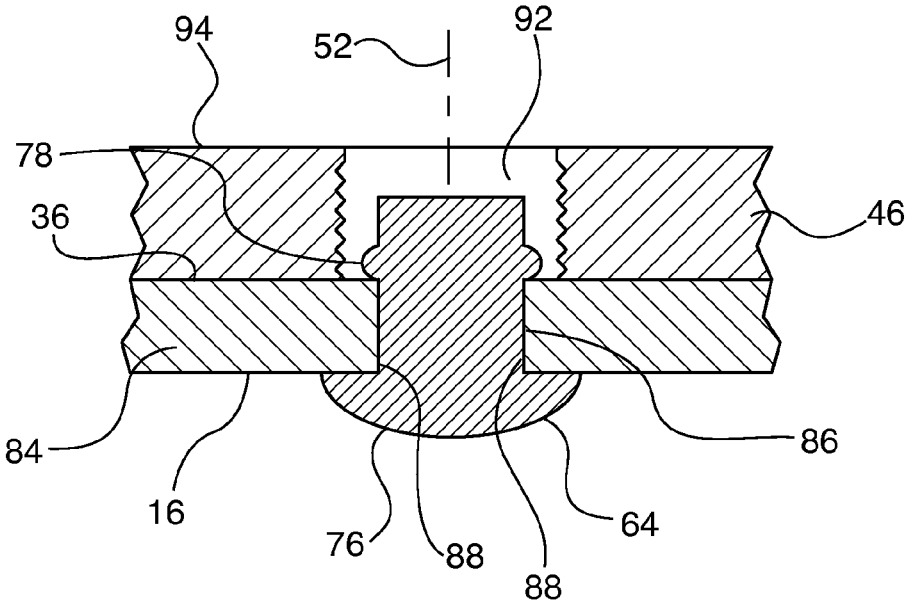
FIG. 6 depicts the lug retainer of FIG. 5 inserted in a lug and a terminal.

Referring to FIGS. 5 and 6, an alternate embodiment for a lug retainer 76 is shown. In this embodiment, the lug retainer 76 includes a ring 78 that projects outwardly from the body 62. The ring 78 divides the body 62 into first 80 and second 82 body portions. A length of the second body portion 82 corresponds to a distance between the lower surface 36 and bottom surface 16 (see FIG. 3) of a lug 84. The lug retainer 76 is fabricated from a resilient material such as a thermoplastic material. In a first position, the walls 63 are oriented substantially parallel to each other such that the ring 78 is larger than a lug aperture 86 formed in the lug 84 (see FIG. 6). Upon insertion of the first portion 80 into the lug aperture 86, the ring 78 contacts an edge 88 of the lug aperture 86. This causes the walls 63 and ring 78 to deflect inwardly toward the second axis 52 thus enabling upward movement of the ring 78 within the lug aperture 86. The body 62 is inserted until the ring 78 is moved past the lower surface 36. When this occurs, the walls 63 and ring 78 snap back to the first position such that the ring 78 abuts against the lower surface 36 and end cap 64 abuts against bottom surface 16, thus capturing the lug retainer 76 within the lug 84. Further, the first portion 80 extends into a terminal aperture 92, thus inhibiting movement of the lug 84 relative to the terminal 46 along the first axis 34. As a result, movement of the lug 84 along both the first 34 and second 52 axes (see FIG. 2) is inhibited. In a further embodiment, a longer body 62 may be used such that the ring 84 abuts against terminal surface 94.

Figure 7:
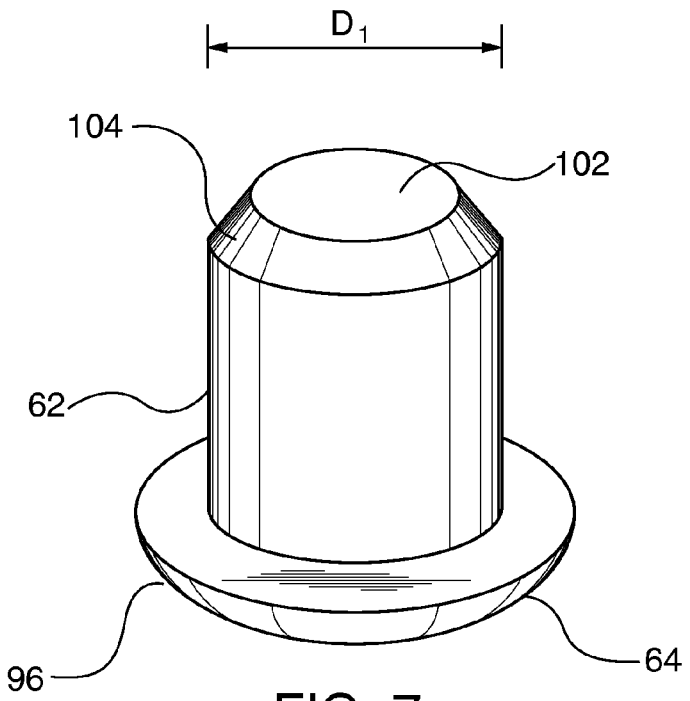
FIG. 7 depicts a further embodiment for a lug retainer.
Figure 8:
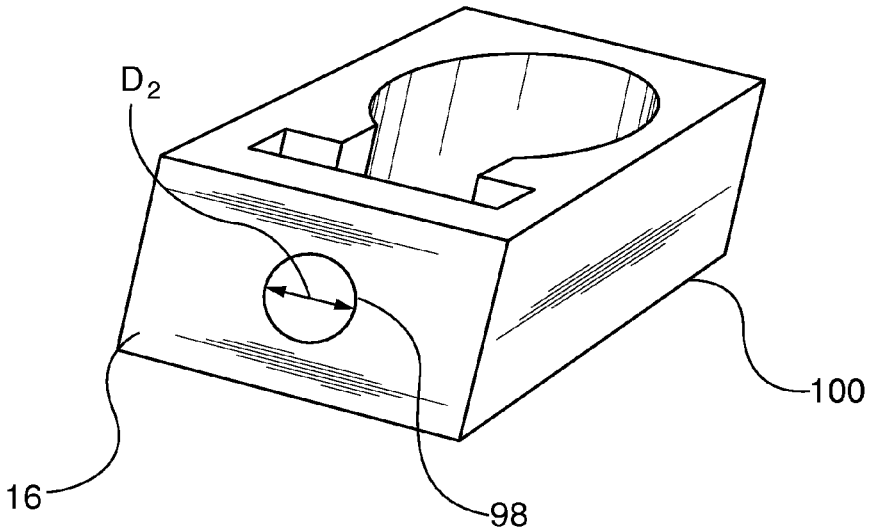
FIG. 8 depicts a lug for use with the lug retainer of FIG. 7.

Referring to FIGS. 7 and 8, a further embodiment for a lug retainer 96 is shown. In this embodiment, a size D1 of the body 62 of the lug retainer 96 is configured to be larger than a size D2 of a lug aperture 98 formed in a lug 100 so as to form a press-fit arrangement. Upon insertion of the retainer 96 into the lug aperture 98, the body 62 is compressed to form a press-fit that attaches the lug retainer 96 to the lug 100. The lug retainer 96 is inserted into the lug aperture 98 until the end cap 64 abuts against bottom surface 16. When this occurs, the body 62 extends through the terminal aperture 92 (see FIG. 6), thus inhibiting movement of the lug 100 relative to the terminal 46 along the first axis 34. An end 102 of the body 62 includes a chamfer 104 that serves as a lead-in to facilitate insertion of the body 62 into the lug aperture 98. In an embodiment, the lug retainer 96 is fabricated from a resilient material such as a thermoplastic material. Further, the body 62 may be either hollow or solid. Alternatively, the press-fit arrangement may be formed between the body 62 and the terminal aperture 92 or between the body 62 and both the lug 98 and terminal 92 apertures.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A lug arrangement for electrically connecting a conductor to a terminal of an electrical power distribution device, comprising:

a lug including a lug opening and first and second holes wherein the lug opening includes a conductor opening for receiving the conductor and a slot for receiving the terminal;

a lug screw threadably engaged with the first hole for compressing the conductor against the terminal; and a lug retainer for insertion into both the second hole and a third hole formed in the terminal wherein the lug retainer includes at least one moveable protrusion for engaging the second hole to attach the lug retainer to the lug thereby inhibiting movement of the lug relative to the terminal.

2. The lug arrangement according to claim 1, wherein the second hole of the lug includes a recess for receiving the at least one protrusion of the lug retainer.

3. The lug arrangement according to claim 1, wherein the lug retainer is moveable between first and second positions.

4. The lug arrangement according to claim 1, wherein the lug retainer inhibits movement of the lug relative to an axis of the terminal.

5. The lug arrangement according to claim 1, further including a sloped portion associated with the at least one protrusion.

6. The lug arrangement according to claim 5, wherein lug retainer includes a wall associated with the sloped portion.

7. The lug arrangement according to claim 6, wherein each wall is moveable to enable insertion of a body of the lug retainer inside the second hole.

8. A lug arrangement for electrically connecting a conductor to a terminal of an electrical power distribution device, comprising:

a lug including a lug opening and first and second holes wherein the lug opening includes a conductor opening for receiving the conductor and a slot for receiving the terminal;

a lug screw threadably engaged with the first hole for compressing the conductor against the terminal; and a lug retainer for insertion into both the second hole and a third hole formed in the terminal wherein the lug retainer includes at least one moveable protrusion and wherein the protrusion is moveable from a first position to a deflected position for enabling insertion of the lug retainer into the second hole and wherein the at least one protrusion is moveable back to the first position in which the at least one protrusion engages the second hole to attach the lug retainer to the lug thereby inhibiting movement of the lug relative to the terminal.

9. The lug arrangement according to claim 8, wherein the lug retainer inhibits movement of the lug relative to an axis of the terminal.

10. The lug arrangement according to claim 8, wherein the at least one protrusion engages the third hole formed in the terminal to attach the lug retainer to the lug thereby inhibiting movement of the lug relative to the terminal.

11. The lug arrangement according to claim 8, further including a sloped portion associated with the at least one protrusion.

12. The lug arrangement according to claim 11, further including a wall associated with the sloped portion.

13. The lug arrangement according to claim 12, wherein each wall is moveable to enable insertion of a body of the lug retainer inside the second hole.

* * * * *